US009598828B2

(12) United States Patent
Raasch

(10) Patent No.: US 9,598,828 B2
(45) Date of Patent: Mar. 21, 2017

(54) SNOWTHROWER INCLUDING POWER BOOST SYSTEM

(71) Applicant: Briggs & Stratton Corporation, Wauwatosa, WI (US)

(72) Inventor: Jason J. Raasch, Cedarburg, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 159 days.

(21) Appl. No.: 14/569,156

(22) Filed: Dec. 12, 2014

(65) Prior Publication Data

US 2015/0096206 A1 Apr. 9, 2015

Related U.S. Application Data

(63) Continuation of application No. 13/092,027, filed on Apr. 21, 2011, now Pat. No. 8,910,616.

(51) Int. Cl.

| | |
|---|---|
| ***E01H 5/09*** | (2006.01) |
| ***F02M 1/02*** | (2006.01) |
| ***F02M 7/17*** | (2006.01) |
| ***F02M 17/48*** | (2006.01) |
| ***F02M 19/12*** | (2006.01) |
| *E01H 5/00* | (2006.01) |

(52) U.S. Cl.

CPC ..... *E01H 5/09* (2013.01); *E01H 5/098* (2013.01); *F02M 1/02* (2013.01); *F02M 7/17* (2013.01); *F02M 17/48* (2013.01); *F02M 19/12* (2013.01)

(58) Field of Classification Search

CPC ..... E01H 5/098; E01H 5/09; F02M 1/02

USPC ..... 261/44.7, 44.8, 44.9, 42; 123/439, 437, 123/442, 704

See application file for complete search history.

(56) References Cited

U.S. PATENT DOCUMENTS

| | | | |
|---|---|---|---|
| 1,128,782 | A | 2/1915 | Hartford |
| 1,265,883 | A | 5/1918 | Church |
| 1,459,981 | A | 6/1923 | McClellan |
| 1,745,492 | A | 2/1930 | Kelch et al. |
| 1,982,945 | A | 12/1934 | Armstrong |
| 2,009,659 | A | 7/1935 | Hill et al. |
| 2,022,094 | A | 11/1935 | Shoemaker et al. |
| 2,134,889 | A | 1/1938 | Phillips |

(Continued)

FOREIGN PATENT DOCUMENTS

| | | |
|---|---|---|
| GB | 0 149 14 | 10/1915 |
| JP | 55-001420 A | 1/1980 |

(Continued)

OTHER PUBLICATIONS

Honda Power Equipment; printed from website http://www.hondapowerequipment.com/products/generators/content.aspx on Mar. 15, 2010, 5 pages.

(Continued)

*Primary Examiner* — Mahmoud Gimie

(74) *Attorney, Agent, or Firm* — Foley & Lardner LLP

(57) ABSTRACT

A carburetor includes a passageway having a constricted section, a nozzle directed into the passageway proximate the constricted section, and a shaft having a surface that at least partially defines the constricted section. The nozzle is configured to deliver fuel to air passing through the passageway, and the surface includes a contour that is configured to be moved relative to the passageway to change the area of the passageway through the constricted section.

20 Claims, 8 Drawing Sheets

(56) References Cited

U.S. PATENT DOCUMENTS 2,138,100 A 11/1938 Howard
2,221,201 A 11/1940 Pope, Jr. et al.
2,241,096 A 5/1941 McCullough
2,338,912 A 1/1944 Ericson
2,367,606 A 1/1945 Olson
2,382,952 A 8/1945 Armstrong
2,393,556 A 1/1946 Olson et al.
2,397,208 A 3/1946 Saco, Jr. et al.
2,450,037 A 9/1948 Dulong
2,499,263 A 2/1950 Troy
2,529,437 A 11/1950 Weinberger
2,533,180 A 12/1950 Rhodes
2,544,607 A 3/1951 Mallory
2,585,814 A 2/1952 McDonald
2,613,657 A 10/1952 Sloane et al.
2,635,596 A 4/1953 Adler
2,716,397 A 8/1955 Heinish
2,781,751 A 2/1957 Benjamin
2,804,552 A 8/1957 McFarland
2,837,070 A 6/1958 Agar
2,867,196 A 1/1959 Francis
2,947,600 A 8/1960 Clayton
3,133,531 A 5/1964 Cramer
3,139,079 A 6/1964 Bettoni
3,209,532 A 10/1965 Morris et al.
3,217,652 A 11/1965 Olson
3,242,741 A 3/1966 Catterson
3,276,439 A 10/1966 Reichenbach
3,280,903 A 10/1966 Stoddard, Jr.
3,306,035 A 2/1967 Morrell
3,354,873 A 11/1967 Burnell
3,476,094 A 11/1969 Guernsey et al.
3,659,499 A 5/1972 Woodward
3,666,057 A 5/1972 Leifer et al.
3,760,785 A 9/1973 Harrison et al.
3,786,869 A 1/1974 McLoughlin
3,847,131 A 11/1974 Hisatomi
3,881,685 A 5/1975 Hase et al.
3,911,063 A 10/1975 Barnes, Jr.
3,937,302 A 2/1976 Palmcrantz
3,971,356 A 7/1976 Schlage
3,982,397 A 9/1976 Laurent
3,983,697 A 10/1976 Goto et al.
3,997,019 A 12/1976 Inoue
4,022,179 A 5/1977 Kalert et al.
4,083,338 A 4/1978 Bertling et al.
4,084,373 A 4/1978 Hashimoto et al.
4,094,284 A 6/1978 Gesell
4,103,652 A 8/1978 Garside et al.
4,117,640 A 10/1978 Vanderstar
4,139,332 A 2/1979 Cantrell et al.
4,154,058 A 5/1979 Mase et al.
4,165,611 A 8/1979 Ishikawa
4,176,642 A 12/1979 Shipinski
4,255,879 A * 3/1981 Greider ..... B60K 28/04 172/42
4,290,399 A 9/1981 Takada et al.
4,304,202 A 12/1981 Schofield
4,342,299 A 8/1982 Haka
4,355,611 A 10/1982 Hasegawa
4,368,704 A 1/1983 Masaki
4,370,960 A 2/1983 Otsuka
4,383,510 A 5/1983 Nakamura et al.
4,387,565 A 6/1983 Otani et al.
4,391,246 A 7/1983 Kawabata et al.
4,395,876 A 8/1983 Marsee et al.
4,425,888 A 1/1984 Engel et al.
4,437,306 A 3/1984 Ikenoya et al.
4,450,932 A 5/1984 Khosropour et al.
4,502,436 A 3/1985 Bonfiglioli et al.
4,510,903 A 4/1985 Sakakiyama
4,526,060 A 7/1985 Watanabe
4,530,334 A 7/1985 Pagdin
4,530,805 A 7/1985 Abbey
4,546,744 A 10/1985 Bonfiglioli
4,549,400 A 10/1985 King
4,559,185 A 12/1985 Seto et al.
4,567,870 A 2/1986 Tumber
4,640,245 A 2/1987 Matsuda et al.
4,660,518 A 4/1987 Tamaki
4,709,675 A 12/1987 Fujita
4,773,369 A 9/1988 Kobayashi et al.
4,783,286 A 11/1988 Lee
4,793,309 A 12/1988 Huffman et al.
4,836,164 A 6/1989 Morozumi et al.
4,836,167 A 6/1989 Huffman et al.
4,884,541 A 12/1989 Marriott
4,941,443 A 7/1990 Yamaguchi et al.
4,944,267 A 7/1990 Mann
4,969,435 A 11/1990 Morikawa et al.
4,977,879 A 12/1990 Schmidt et al.
5,003,949 A 4/1991 Fanner et al.
5,035,580 A 7/1991 Simonette
5,060,744 A 10/1991 Katoh et al.
5,069,180 A 12/1991 Schmidt et al.
5,146,889 A 9/1992 Swanson et al.
5,186,142 A 2/1993 Brunelli et al.
5,203,302 A 4/1993 Parnitzke
5,208,519 A 5/1993 Dykstra et al.
5,235,804 A 8/1993 Colket et al.
5,235,943 A 8/1993 Fiorenza, II
5,293,854 A 3/1994 Tracy et al.
5,345,763 A 9/1994 Sato
5,351,529 A 10/1994 Locke, Sr.
5,431,013 A 7/1995 Yamaki et al.
5,459,664 A 10/1995 Buckalew
5,459,998 A 10/1995 Hosoya et al.
5,479,908 A 1/1996 Grinberg et al.
5,503,125 A 4/1996 Gund
5,526,786 A 6/1996 Beck et al.
5,595,531 A 1/1997 Niemela et al.
5,642,711 A 7/1997 Boner et al.
D382,853 S 8/1997 Crawford
5,666,804 A 9/1997 Sekiya et al.
5,680,024 A 10/1997 Ehle et al.
5,720,906 A 2/1998 Yamanaka et al.
5,726,503 A 3/1998 Domanski et al.
5,810,560 A 9/1998 Tanaka
5,902,971 A 5/1999 Sato et al.
6,021,370 A 2/2000 Bellinger et al.
6,092,793 A 7/2000 Yanagii
6,113,193 A 9/2000 Kunzeman
6,216,453 B1 4/2001 Maurer
6,276,449 B1 8/2001 Newman
6,365,982 B1 4/2002 Iles et al.
6,435,482 B1 8/2002 Omi et al.
6,971,369 B1 12/2005 Mitchell et al.
6,983,736 B2 1/2006 Mitchell et al.
7,353,802 B1 4/2008 Iwata et al.
7,373,921 B2 5/2008 Geyer et al.
7,950,366 B2 5/2011 Arai et al.
8,567,371 B2 10/2013 Vaughn et al.
2002/0053339 A1 5/2002 Bootle et al.
2003/0037749 A1 2/2003 Imafuku et al.
2004/0112333 A1 6/2004 Mitchell et al.
2006/0054381 A1 3/2006 Takemoto et al.
2006/0151891 A1 7/2006 Meyer
2007/0068496 A1 3/2007 Wright
2007/0079604 A1 4/2007 Macaluso
2007/0240404 A1 10/2007 Pekrul et al.
2008/0014096 A1 1/2008 Gilpatrick
2008/0245899 A1 10/2008 Parris et al.
2009/0183395 A1* 7/2009 Sugiura ..... E01H 5/04 37/259
2011/0005024 A1 1/2011 Spitler et al.
2011/0214641 A1 9/2011 Vaughn et al.
2011/0226217 A1 9/2011 Raasch

FOREIGN PATENT DOCUMENTS

JP 61-207836 9/1986
JP 11-093750 4/1999

(56) References Cited

FOREIGN PATENT DOCUMENTS

| | | |
|---|---|---|
| SU | 853138 | 8/1981 |
| SU | 1740741 A1 | 6/1992 |

OTHER PUBLICATIONS

Honda; V-Twin Engines, © 2002, American Honda Motor Co., Inc., 10 pages.
Honda; V-Twin Series Engines, © 2009, American Honda Motor Co., Inc., 11 pages.
International Search Report and Written Opinion for International Application No. PCT/US2012/33891, mail date Aug. 9, 2012, 6 pages.
International Search Report and Written Opinion for International Application No. PCT/US2013/043758, dated Sep. 24, 2013, 16 pages.

* cited by examiner

SNOWTHROWER INCLUDING POWER BOOST SYSTEM

CROSS-REFERENCE TO RELATED PATENT APPLICATIONS

This application claims the benefit of U.S. application Ser. No. 13/092,027 filed Apr. 21, 2011, all of which is incorporated herein by reference in its entirety.

BACKGROUND

The present invention relates generally to the field of carburetor systems. More specifically, the present invention relates to carburetor systems for engines configured to run outdoor power equipment, such as snow throwers.

Snow throwers and other types of outdoor power equipment are typically driven by an internal combustion engine. The engine includes a carburetor, which adds fuel to air flowing through the engine for combustion processes occurring within the engine. The carburetor includes a passageway through which air typically flows from an air cleaner or filter to a combustion chamber of the engine.

Along the passageway, the carburetor includes a venturi section having a constricted area, where the cross-sectional area orthogonal to the flow of air through the carburetor is reduced relative to portions of the passageway before and after the constricted area. The carburetor further includes a nozzle in or near the venturi section that is in fluid communication with fuel.

Constriction of the passageway through the venturi section increases the velocity of air passing through the constricted area, which generates low pressure at the nozzle. The low pressure pulls fuel through the nozzle and into the air. The fuel mixed with the air is then burned in the combustion chamber to power the engine, which in turn drives a crankshaft that powers the auger of the snow thrower.

SUMMARY

One embodiment of the invention relates to a carburetor. The carburetor includes a passageway having a constricted section, a nozzle directed into the passageway proximate the constricted section, and a shaft having a surface that at least partially defines the constricted section. The nozzle is configured to deliver fuel to air passing through the passageway, and the surface includes a contour that is configured to be moved relative to the passageway to change the area of the passageway through the constricted section.

Another embodiment of the invention relates to an engine, which includes a fuel tank, a well configured to hold fuel delivered from the fuel tank, an air intake, a combustion chamber, and a passageway configured to channel air from the air intake to the combustion chamber. The passageway includes a surface at least partially defining a constricted section of the passageway, where the surface is configured to be adjusted to change the area of the passageway through the constricted section. The engine further includes a nozzle, a vent configured to connect the well with outside air, and a variable restrictor configured to limit the connection provided by the vent between the well and outside air. The nozzle is in fluid communication with the well and is directed into the passageway proximate to the constricted section, which provides a relative low pressure in air passing through the passageway that draws fuel from the nozzle to the air. The degree of restriction provided by the variable restrictor is a function of the area of the constricted section of the passageway.

Yet another embodiment of the invention relates to outdoor power equipment, which includes a frame, wheels coupled to the frame, a fuel tank, and an engine mounted to the frame. The engine includes an air intake, a combustion chamber, and a passageway configured to channel air from the air intake to the combustion chamber. The passageway has a surface at least partially defining a constricted section of the passageway, where the surface is configured to be adjusted to change the area of the passageway through the constricted section. The engine further includes a well configured to hold fuel delivered from the fuel tank, and a nozzle in fluid communication with the well and directed into the passageway proximate to the constricted section of the passageway. The constricted section of the passageway provides a relative low pressure in air passing through the passageway that draws fuel from the nozzle to the air. The outdoor power equipment further includes a rotating tool driven by the engine, and a control interface configured to allow an operator to adjust the surface at least partially defining the constricted section of the passageway when the engine is in a wide-open throttle configuration, which changes the area of the passageway through the constricted section.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
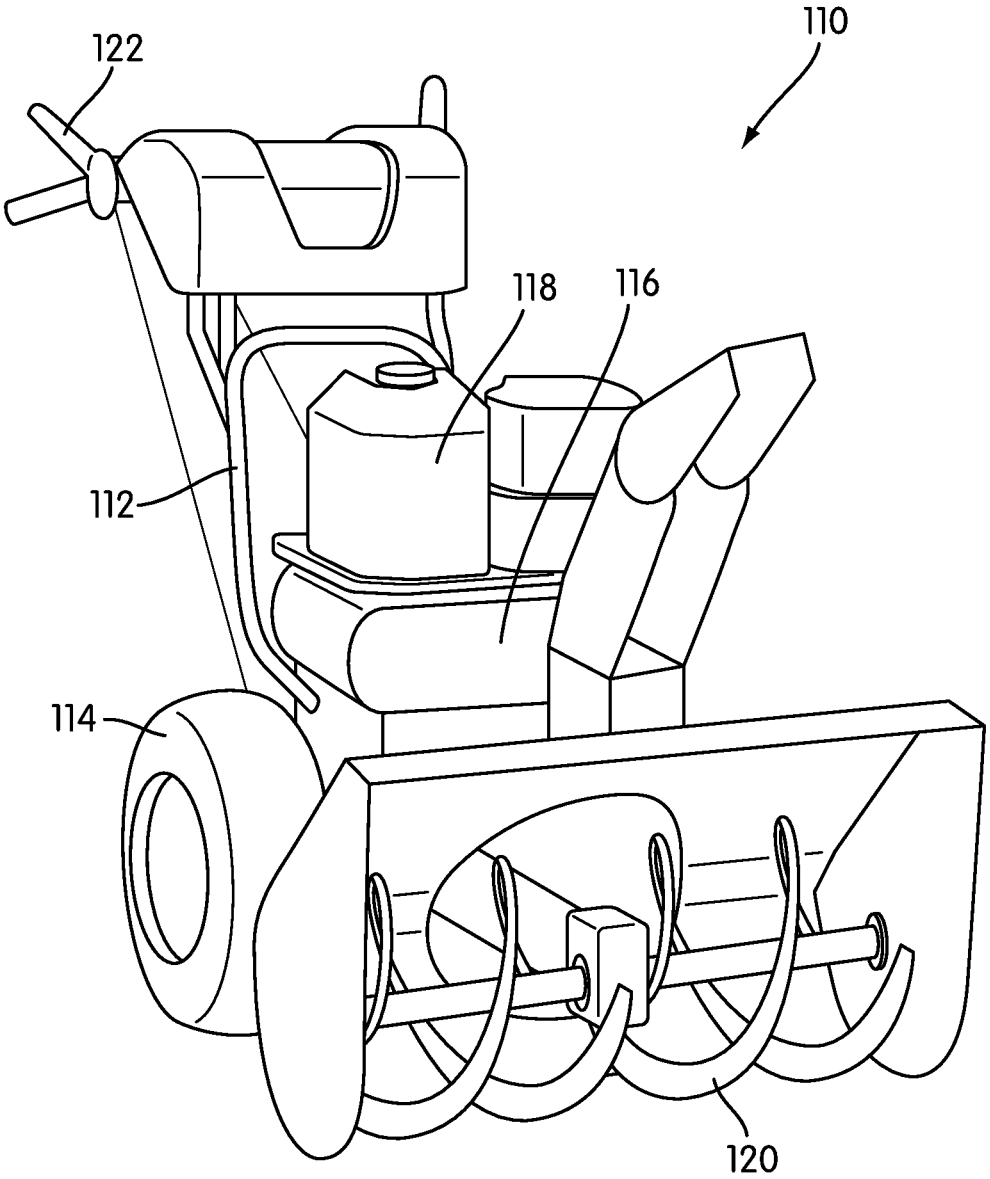
FIG. 1 is a perspective view of a snow thrower according to an exemplary embodiment of the invention.

Referring to FIG. 1, outdoor power equipment in the form of a snow thrower 110 includes a frame 112, wheels 114 coupled to the frame 112, an engine 116, and fuel tank 118. The snow thrower 110 further includes a rotating tool in the form of an auger 120 that is configured to be driven by the engine 116. A control interface in the form of one or more of a throttle lever 122, on/off switch, and drive settings, or other features is coupled to the frame 112. While FIG. 1 shows the snow thrower 110, in other embodiments, outdoor power equipment may be in the form of a broad range of equipment, such as a walk-behind or driving lawnmower, a rotary tiller, a pressure washer, a tractor, or other equipment using an engine.

Figure 2:
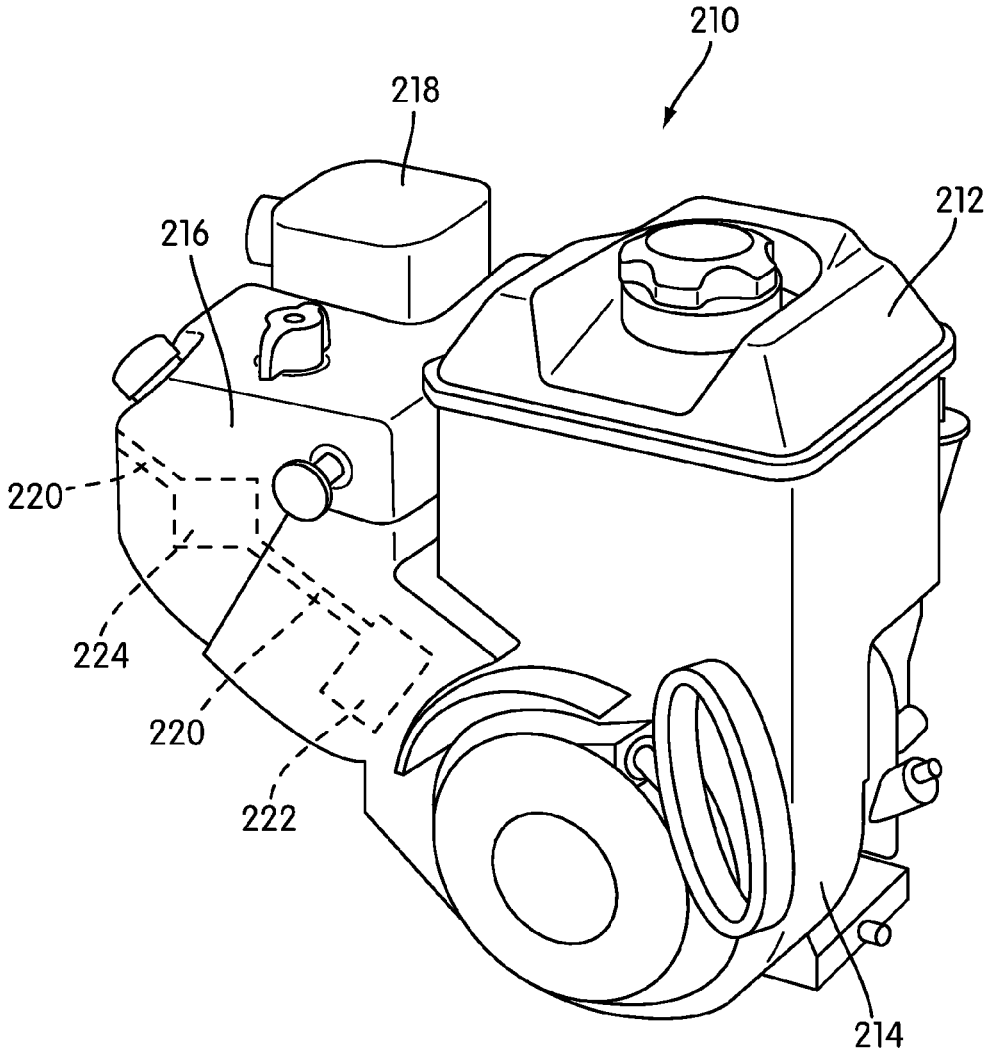
FIG. 2 is a perspective view of an engine according to an exemplary embodiment of the invention.

Referring to FIG. 2, an engine in the form of a small, single-cylinder, four-stroke cycle, internal combustion engine 210 includes a fuel tank 212, an engine block 214, an air intake 216, and an exhaust 218. Interior to the engine 210, the engine 210 includes a passageway 220 configured to channel air from the air intake 216 to a combustion chamber 222. Along the passageway 220, fuel is mixed with the air in a carburetor 224 or other fuel injection device. Combustion in the combustion chamber 222 converts chemical energy to mechanical energy (e.g., rotational motion; torque) via a piston, connecting rod, and crankshaft, which may then be coupled to one or more rotating tools (e.g., blade, alternator, auger, impeller, tines, drivetrain) of outdoor power equipment.

Figure 3:
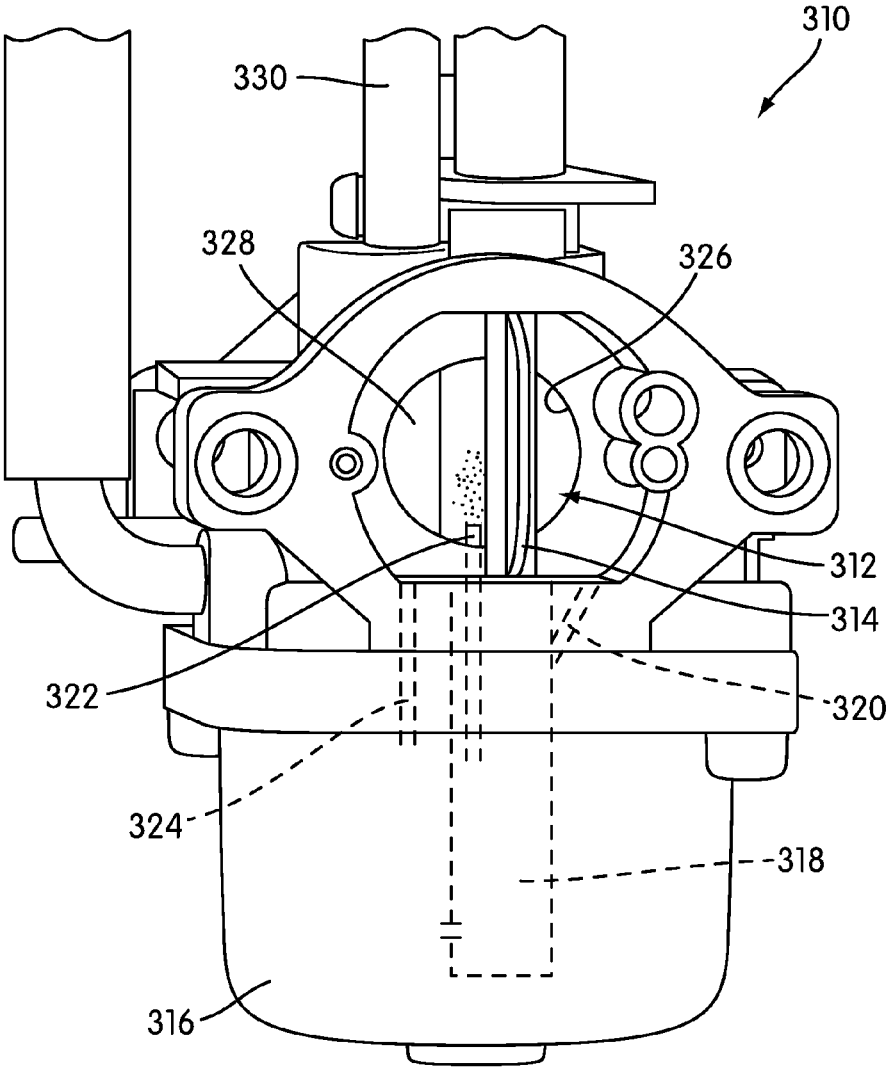
FIG. 3 is a perspective view of a carburetor in a first configuration according to an exemplary embodiment of the invention.
Figure 4:
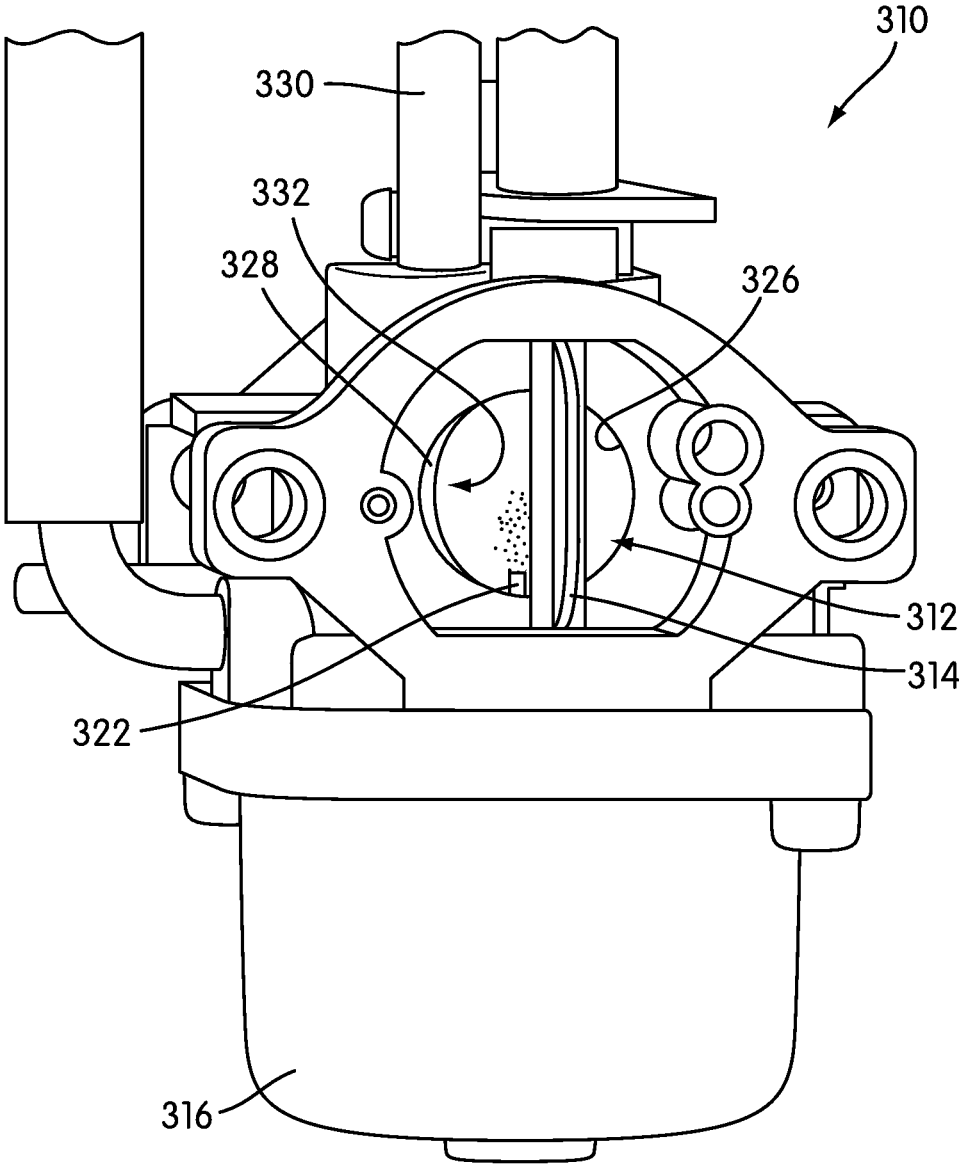
FIG. 4 is a perspective view of the carburetor of FIG. 3 in a second configuration.

Referring now to FIGS. 3-4, a carburetor 310 for an engine (see, e.g., engine 210 as shown in FIG. 2) includes a throat 312 (e.g., conduit, passage, flow path) and, in some embodiments, at least one plate 314 (e.g., throttle plate, choke plate, both throttle and choke plates) configured to function as a butterfly valve to control the flow of air, or a mixture of fuel and air, through the carburetor 310. In FIGS. 3-4, the plate 314 is in an open configuration (e.g., wide-open throttle). According to an exemplary embodiment, the throat 312 of the carburetor 310 is positioned along a passageway extending from an air intake of the engine to a combustion chamber of the engine (see, e.g., passageway 220 as shown in FIG. 2).

The carburetor 310 is coupled to (e.g., in fluid communication with) a fuel tank (see, e.g., fuel tank 118 as shown in FIG. 1) by way of a fuel line or other conduit. The fuel tank may be mounted to the engine, integrated with the engine, or positioned on a frame of outdoor power equipment apart from the engine. In some embodiments the carburetor 310 includes a bowl 316 (e.g., container) that receives fuel from the fuel line. In some such embodiments, a float coupled to a valve is used to regulate the flow of fuel from the fuel line into the bowl 316. From the bowl 316, the fuel is delivered to a well 318 of the carburetor 310 (e.g., emulsion tube well), which is also coupled to a vent 320 and a nozzle 322. In some embodiments, air flows into the well 318 through the vent 320 and mixes with the fuel. Another vent 324 may be coupled to the bowl 316.

According to an exemplary embodiment, the carburetor 310 includes a constricted section 326 (e.g., narrower segment, venturi) integrated with the throat 312 that is bordered by wider portions of the passageway. The nozzle 322 of the carburetor 310 is directed into the passageway proximate to the constricted section 326, such as along the portion of the passageway closely following the most constricted portion of the constricted section 326. As air flows along the passageway through the carburetor 310, the velocity of the air increases through the constricted section 326. The increase in velocity corresponds to a decrease in pressure, which acts upon the nozzle 322, drawing fuel through the nozzle 322 and into the flow of air through the passageway.

According to an exemplary embodiment, the carburetor 310 further includes a surface 328 that at least partially defines the constricted section 326. The surface 328 is configured to be adjusted to change the area of the passageway through the constricted section 326. In some embodiments, the surface 328 is at least a portion of a contour on a shaft 330. As the shaft 330 is moved relative to the passageway, the orientation or position of the contour is changed relative to the passageway, which changes the shape of the surface 328 and the corresponding area of the constricted section 326 of the passageway.

In some embodiments, the surface 328 includes a section of the shaft 330. In such embodiments, the shaft 330 is substantially cylindrical, but includes a recess 332 (e.g., cut, open portion) on a side of the shaft 330 (FIG. 4). The surface 328 of the shaft 330 that at least partially forms the constricted section 326 of the passageway changes as the shaft 330 is moved (e.g., rotated, translated) relative to the passageway. In a first configuration (e.g., normal mode), the recess 332 is not exposed to the passageway (FIG. 3), which corresponds to greater air flow restriction of the constricted section 326. In a second configuration (e.g., power boost, boost mode), the recess 332 is exposed to the passageway (FIG. 4), which corresponds to lesser air flow restriction of the constricted section 326. In contemplated embodiments, the surface that adjusts the area of the constricted section is on the end of a shaft, which is translated relative to the passageway to change the area of the constricted section.

In the second configuration, the carburetor 310 allows for a greater volume of air to flow through the passageway by reducing the restriction provided by the constricted section 326. However, the velocity of air through the constricted section 326 may correspondingly be reduced, decreasing the vacuum experienced at the end of the nozzle 322 that is open to the passageway. In some embodiments, a vent connecting the well 318 to outside air is at least partially restricted when the carburetor 310 is in the second configuration, which is intended to increase the amount of fuel pulled through the nozzle 322, by decreasing the flow of outside air into the well 318 in response to suction from the nozzle 322. Instead, a greater amount of fuel is pulled into the well 318 from the bowl 316 in response to suction from the nozzle 322. In addition, less air is available to mix with the fuel that exits the nozzle 322. In contemplated embodiment, a variable restrictor is integrated with the nozzle, the bowl, the fuel line, or another part of the engine to adjust the flow rate of fuel or air to compensate for changes in air pressure through the constricted section 326 of the passageway.

Figure 5:
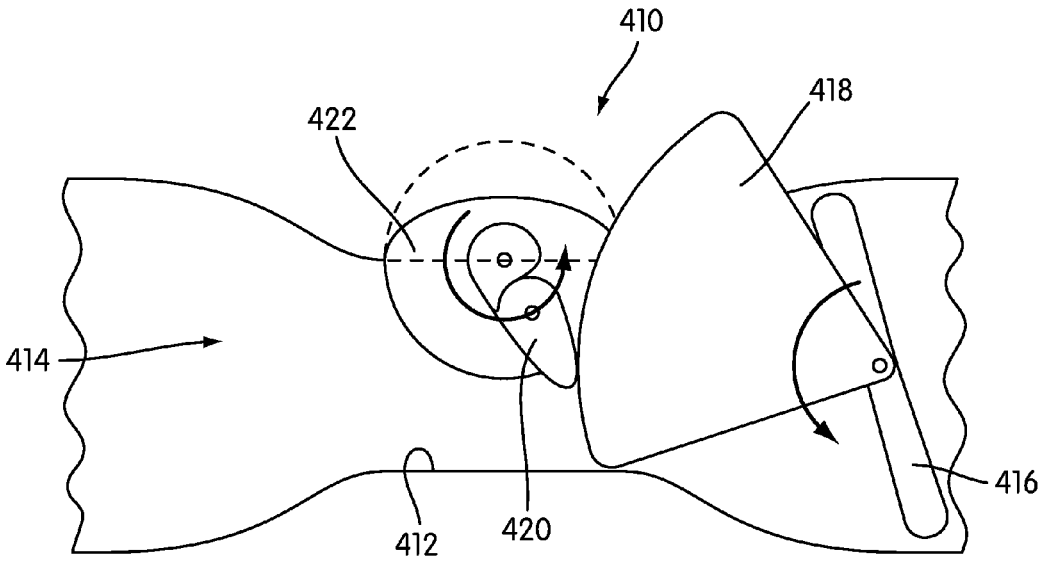
FIG. 5 is a schematic view of a locking system for a carburetor in a first configuration according to an exemplary embodiment of the invention.
Figure 6:
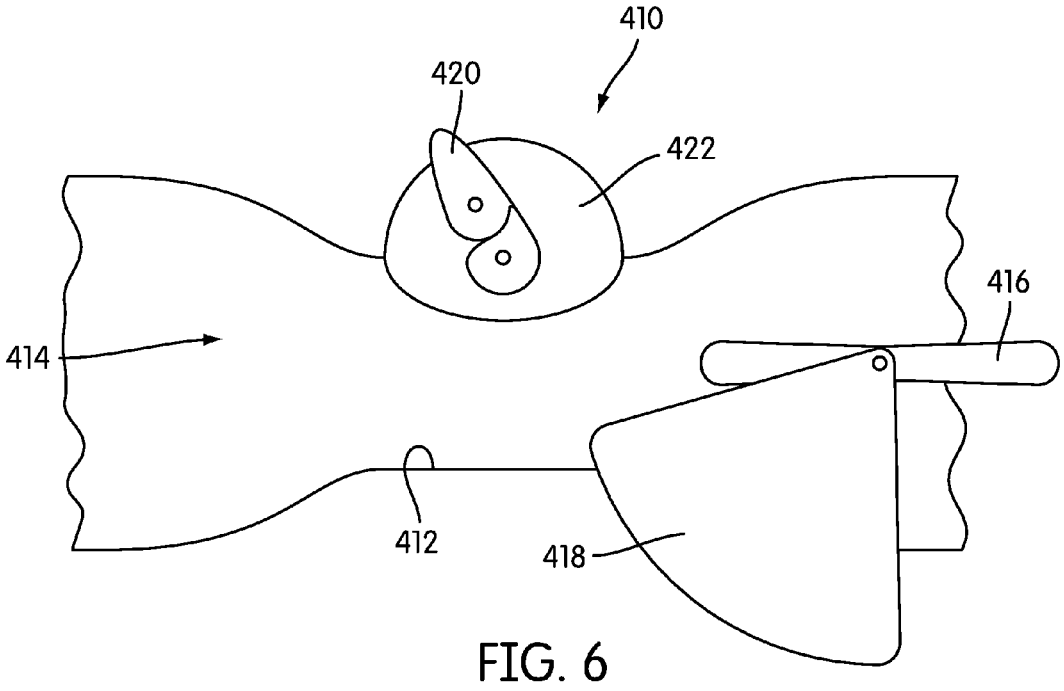
FIG. 6 is a schematic view of the locking system of FIG. 5 in a second configuration.

Referring to FIGS. 5-6, a locking system 410 (e.g., interlock, blocking system) is configured to limit the ability to change the area of a constricted section 412 of a passageway 414 when a throttle plate 416 of the passageway 414 is not in the wide-open throttle position. For example, the area of the constricted section 412 may be locked and thereby not able to be manually adjusted when the throttle plate 416 of the passageway 414 is not in the wide-open throttle position. The locking system 410 may be mechanically, electrically, pneumatically, or otherwise controlled, and may include interfering gears, locking solenoids, releasable hooks, sliding latches, or other components for interlocking parts or limiting movement.

According to an exemplary embodiment, the locking system 410 is mechanically-controlled via interaction of cams. In FIG. 5, a first cam 418 coupled to the throttle plate 416 interferes with a second cam 420 coupled to a vertical shaft 422 extending through a portion of the constricted section 412 of the passageway 414. When the throttle plate 416 is rotated to an open configuration (e.g., wide-open throttle) as shown in FIG. 6, the first cam 418 no longer interferes with the second cam 420. An operator or controller of the shaft 422 is able to rotate the shaft 422 counterclockwise, to change the portion of the shaft 422 that is exposed to the passageway 414, and thereby change the area of the constricted section 412. In some embodiments, the second cam 420 includes two parts that allow for free rotation in one direction, while interlocking to hold the shape of the second cam 420 when rotated in the opposite direction. For example, the two parts of the second cam 420 allow the second cam 420 to freely rotate clockwise to return the second cam 420 to the position of FIG. 5 from the position of FIG. 6, even if the first cam 418 is already in the position of FIG. 5.

Figure 7:
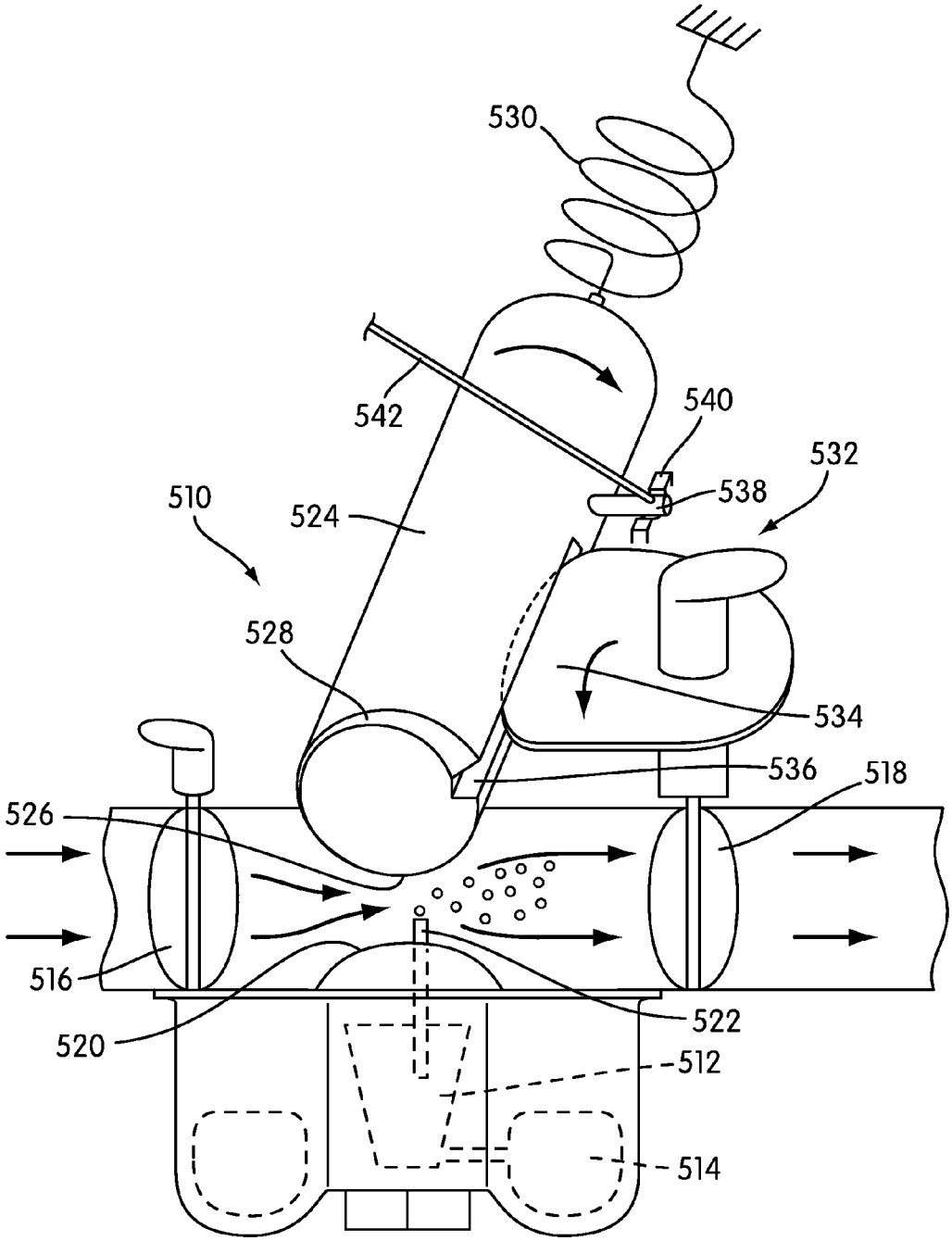
FIG. 7 is a schematic view of a carburetor according to another exemplary embodiment of the invention.

Referring to FIG. 7, a carburetor 510 for an internal combustion engine includes a flow path for air passing between an air intake and a combustion chamber of the engine. The carburetor includes a choke plate 516, a throttle plate 518, and a constricted section 520. A nozzle 522 is open to the flow path proximate to the constricted section 520 and is configured to supply fuel to air passing through the carburetor 510. According to an exemplary embodiment, the fuel is provided to the nozzle 522 from a well 512 in the carburetor 510, which is in communication with a bowl 514 of the carburetor 510.

According to an exemplary embodiment, the carburetor 510 includes a shaft 524 that forms a surface 526 of the constricted section 520 of the flow path. As shown in FIG. 7, the shaft 524 is oriented horizontally with respect to the flow path and includes a contour 528 associated with the constricted section 520. According to an exemplary embodiment, the contour 528 is a segment of a spiral, where the radius of the contour 528 continuously decreases from one angular position to the other about the shaft 524 (i.e., from one end of the contour 528 to the other about the shaft 524). As the shaft 524 is rotated relative to the flow path, the amount of the surface 526 protruding into the constricted section 520 of the flow path decreases, which widens the constricted section 520. Use of a spiral segment or other continuously variable geometry allows for a continuously variable area of the constricted section 520, which may facilitate optimization of the flow path for a given load on the engine, reducing carbon emissions, improving engine performance (e.g., create more power, improved start-ability, and improved "load pickup" or response to changes in load), and increasing fuel efficiency.

According to an exemplary embodiment, the shaft 524 is biased to a first orientation, which corresponds to a narrower area of the constricted section 520. In some embodiments, the shaft is biased by a torsion spring 530 coupled to the shaft 524. In other embodiments, a coil spring or other elastic member is coupled to a side or end of the shaft 524 to bias the shaft 524 in the first orientation. In still other embodiments, the end of the shaft 524 includes a moment arm with a biasing spring or other elastic member, or weight. Bushing, bearings, end pins, and other constraints may be used to limit or facilitate rotation of the shaft.

In some embodiments, the carburetor includes a locking system 532. According to an exemplary embodiment, the locking system 532 includes a cam 534 and a slot 536. The cam 534 is coupled to the throttle plate 518 and the slot 536 (e.g., ledge, lip, flange) is integrated with the shaft 524. If the throttle plate 518 is at least partially closed, the cam 534 is positioned in the slot 536, interlocking the cam 534 and slot 536 to limit the ability to rotate the shaft 524. If the throttle plate 518 is moved to the wide-open throttle position, then the cam 534 is positioned outside of the slot 536, and the shaft 524 is free to rotate. A peg 538 or other surface in a seat 540 or other constraint may prevent the shaft 524 from rotating beyond set limits. An operator or controller can rotate the shaft 524 counterclockwise via a linkage 542.

In contemplated embodiments, a carburetor includes a plate having a curved surface that translates relative to the constricted section of the carburetor, or a disk having a variable shape on the periphery of the disk. As different portions of the surface interface with the flow path through the carburetor, the area of the constricted section changes. In still other contemplated embodiments, a belt is used to expand or contract a flexible or moveable surface that forms the constricted section of the carburetor. The area of the constricted section is inversely related to tension in the belt. In other contemplated embodiments, two or more shafts are used in combination to change the area of a constricted section of the flow path. The shafts may be mechanically coupled to one another.

Figure 8:
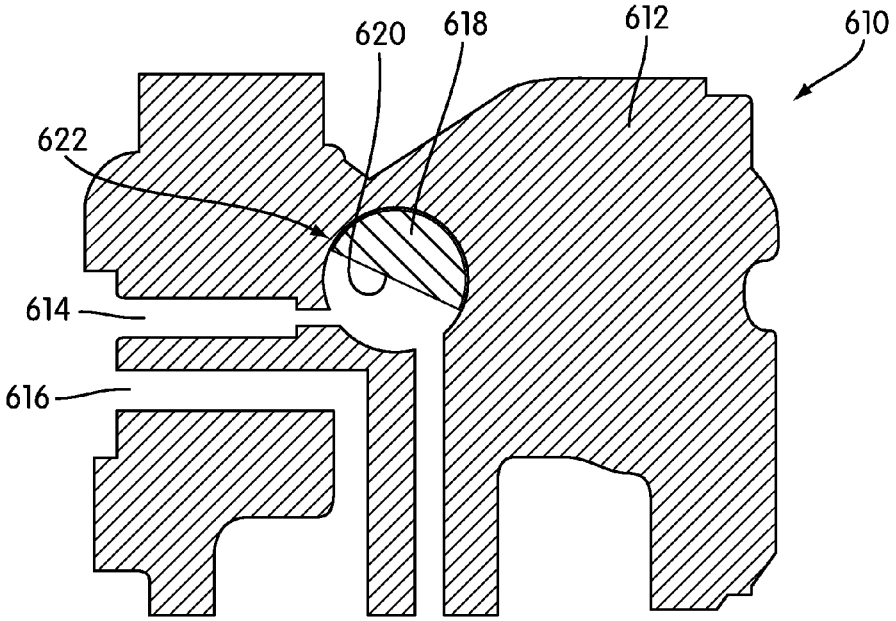
FIG. 8 is a sectional view of vent passages of a carburetor in a first configuration according to an exemplary embodiment of the invention.
Figure 9:
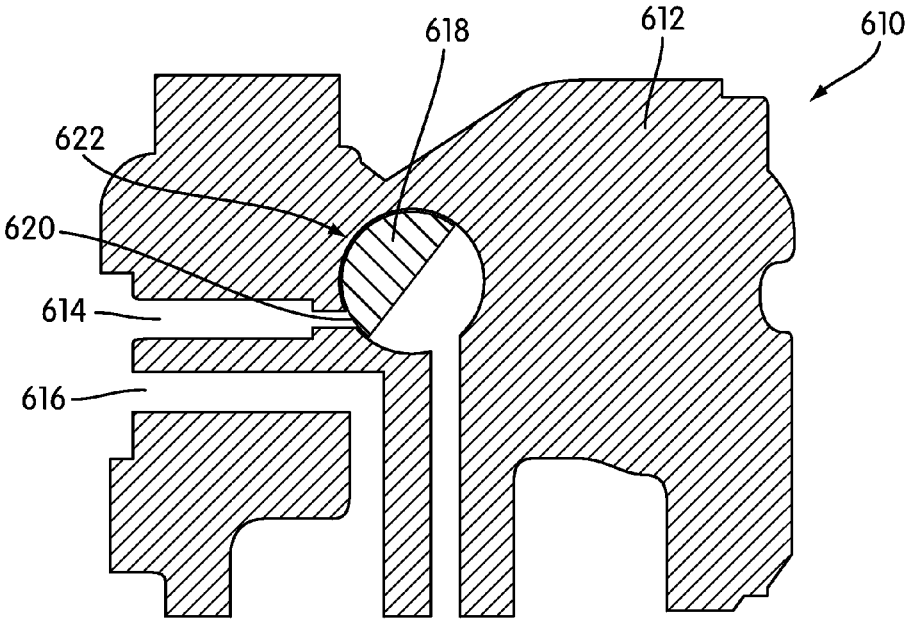
FIG. 9 is a sectional view of the vent passages of FIG. 8 in a second configuration.

Referring now to FIGS. 8-9, a structure of an engine, such as a wall 612 of a carburetor 610, includes a first vent 614 (e.g., conduit, passageway, flow path, channel) and a second vent 616. According to an exemplary embodiment, the first vent 614 connects a well of the carburetor (see, e.g., well 512 as shown in FIG. 7) to outside air (e.g., air at atmospheric pressure, air flowing through the engine prior to passage through the constricted section of the carburetor), and the second vent 616 connects the bowl (see, e.g., bowl 514 as shown in FIG. 7) of the carburetor 610 to outside air. Air from the first vent 614 is added to fuel in the well, and the combined mixture is delivered to air passing through the carburetor 610 by a nozzle (see, e.g., nozzle 522 as shown in FIG. 7).

According to an exemplary embodiment, low pressure from a constricted section integrated with a main flow path (see, e.g., constricted section 520 as shown in FIG. 7) through the carburetor 610 provides suction to draw fuel (and air) through the nozzle. As the fuel is removed from the well via the nozzle, additional fuel is delivered to the well from the bowl and additional air is delivered to the well from the first vent 614. The ratio of additional fuel to additional air delivered to the well is a function of the amount of resistance to flow (e.g., drag, friction, change in moment) provided between the bowl and the well, the amount of resistance through the first vent to the well, the relative viscosities of fuel and air, as well as other factors. All other things being equal, as the resistance through the first vent 614 is increased, a greater amount of fuel will be delivered from the bowl to the well in response to vacuum pressure from the nozzle, and vice versa.

According to an exemplary embodiment, the carburetor 610 includes an adjustable surface (see, e.g., surface 526 as shown in FIG. 7) of the constricted section. In some embodiments, the surface may be manually adjusted, such as by way of a linkage to a control lever or button. In other embodiments, the surface is automatically controlled, such as by a feedback system that is responsive to loading on the engine. In either case, adjustment of the surface changes the area of the constricted section open to air passing through the constricted section. As the constricted section is widened, the velocity of the air passing through the constricted section generally decreases and the suction acting upon the nozzle decreases.

In some embodiments, to increase the amount of fuel provided to air passing through the constricted section as the area of the constricted section widens, restriction in the first vent 614 is increased, decreasing the amount of outside air flowing to the well while increasing the amount of fuel from the bowl flowing to the well. In other contemplated embodiments, restriction between the bowl and the well is decreased in response to an increase in the area through the constricted section. In still other contemplated embodiments, air pressure is increased in the bowl to push more fuel in the bowl into the well in response to an increase in the area through the constricted section. In other embodiments, components that control the amount of fuel injected into the air flowing through the constricted section are otherwise adjusted in response a change in area through the constricted section.

Still referring to FIGS. 8-9, a shaft (see, e.g., shaft 524 as shown in FIG. 7) that provides an adjustable surface of the constricted section of the carburetor 610 is also associated with the first vent 614. In some such embodiments, a portion 618 of the shaft includes a surface 620 of a variable restrictor 622 coupled to the first vent 614. Rotation or translation of the shaft to change the area of the constricted section of the carburetor 610 simultaneously causes the shaft to change the degree of restriction provided by the variable restrictor 622 of the first vent 614. In some embodiments, as the area of the constricted section increases, the amount of restriction in the first vent 614 also increases, and vice versa. In other contemplated embodiments, a restrictor for the first vent not a portion of the shaft, but is mechanically coupled to the shaft, such as by gearing or cams.

Figure 10:
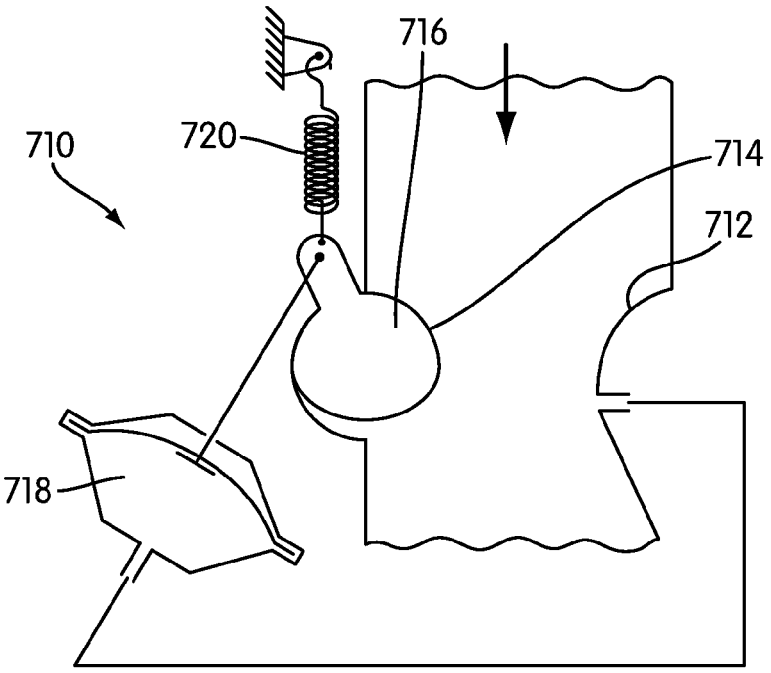
FIG. 10 is a schematic view of a control system for a carburetor in a first configuration according to an exemplary embodiment of the invention.
Figure 11:
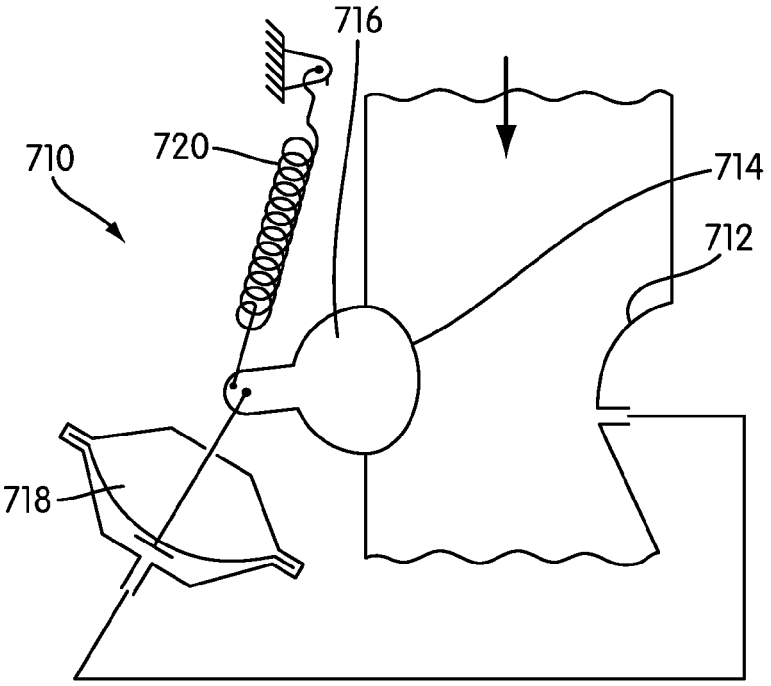
FIG. 11 is a schematic view of the control system of FIG. 10 in a second configuration.

Referring now to FIGS. 10-11, a carburetor system 710 for an engine includes a constricted section 712. The constricted section 712 is at least partially formed from a surface 714 that is adjustable. According to an exemplary embodiment, the surface 714 is formed from a contour (e.g., non-circular portion) of a shaft 716. As the shaft 716 moved relative to a flow path through the constricted section 712, the surface 714 protrudes into the constricted section 712 by a different amount, changing the area through the constricted section 712.

According to an exemplary embodiment, the carburetor system 710 further includes an actuator 718 coupled to the shaft 716, which is configured to move the shaft 716 as a function of loading on the engine. In some embodiments, the actuator 718 is pressure-sensitive (e.g., piston and rod; diaphragm) and is coupled to the engine such that the actuator 718, which is in communication with vacuum pressure of the engine. Vacuum pressure of the engine is related to loading of the engine. In some embodiments, the actuator 718 is coupled to the flow path through the carburetor system 710, following the constricted section 712. In other embodiments, the actuator 718 is coupled to the crankcase.

During operation, a spring 720 may bias the shaft 716 so that the surface 714 forming a portion of the constricted section 712 is in a first configuration, which corresponds to a narrower opening through the constricted section 712. If loading on the engine increases and vacuum pressure of the engine increases (i.e., venturi pressure decreases and vacuum increase), then the actuator 718 will overcome the spring 720, moving the shaft 716 to a second configuration, which corresponds to a wider constricted section 712. The wider constricted section 712 allows for more air to flow through the carburetor system 710 to increase the combustion processes and provide a greater output for the engine. When the loading is reduced and upon engine startup, the spring 720 will bias the shaft 716 into the first configuration.

In some embodiments, a locking system is used with the carburetor system 710 to prevent the shaft 716 from rotating when a throttle plate (see, e.g., throttle plate 518 as shown in FIG. 7) of the carburetor system 710 is not in a wide-open throttle configuration. In some embodiments, the carburetor system 710 may allow for a manual override of the actuator 718, such as by a power-boost button linked to the shaft 716. In some embodiments, the shaft 716 or the actuator 718 may be coupled to a variable restrictor associated with vents to a well or bowl of the carburetor system 710 (see, e.g., first and second vents 614, 616 as shown in FIGS. 8-9). In some embodiments, the surface 714 of the shaft 716 may be shaped as a segment of a spiral such that the area of the constricted section 712 is continuously variable. In contemplated embodiments, a bar, plate, or other structure may include a contoured surface that translates relative to the flow path through the carburetor system 710, to change the area of the constricted section 712.

The construction and arrangements of the carburetor system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A snow thrower having a power boost mode, the snow thrower comprising:

a frame;

wheels coupled to the frame;

a fuel tank;

an engine mounted to the frame, comprising:

an air intake;

a combustion chamber;

a passageway configured to channel air from the air intake to the combustion chamber, wherein the passageway comprises a surface at least partially defining a constricted section of the passageway, and wherein the surface is configured to be adjusted to change the area of the passageway through the constricted section;

a well configured to hold fuel delivered to the well from the fuel tank; and a nozzle in fluid communication with the well and directed into the passageway proximate to the constricted section of the passageway, whereby the constricted section of the passageway provides a relative low pressure in air passing through the passageway that draws fuel from the nozzle to the air;

a rotating tool driven by the engine; and a control interface, wherein manual control of the control interface increases the flow rate of air through the passageway to increase the combustion processes of the engine and provide a power boost mode having greater output for the engine.

2. The snow thrower of claim 1, wherein the control interface comprises a power boost button.

3. The snow thrower of claim 1, wherein the control interface is configured to adjust the surface in order to change the area of the passageway through the constricted section.

4. The snow thrower of claim 1, further comprising:

a shaft comprising the surface; and an actuator coupled to the shaft and configured to move the shaft as a function of loading on the engine; wherein the control interface is linked to the shaft and is further configured to override the actuator by adjusting the shaft.

5. The snow thrower of claim 4, further comprising a vent configured to connect the well with outside air, wherein at least one of the actuator and the shaft is coupled to a variable restrictor associated with the vent and configured to limit the connection provided by the vent between the well and outside air.

6. The snow thrower of claim 4, further comprising a spring biasing the shaft to a first configuration corresponding to a narrower opening through the constricted section, wherein the actuator is in communication with a vacuum pressure of the engine, an increase in loading on the engine increases the vacuum pressure of the engine, and the actuator is configured to overcome the spring and move the shaft to a second configuration corresponding to a wider opening through the constricted section in response to the increase in loading on the engine.

7. The snow thrower of claim 5, wherein the spring is configured to bias the shaft to the first configuration in response to at least one of a reduction in loading on the engine and engine startup.

8. The snow thrower of claim 1, further comprising:

a shaft comprising the surface and a recess;

wherein the control interface is further configured to adjust the shaft to expose the recess to the passageway.

9. A snow thrower comprising:

a frame;

wheels coupled to the frame;

a fuel tank;

an engine mounted to the frame, comprising:

an air intake;

a combustion chamber;

a passageway configured to channel air from the air intake to the combustion chamber, wherein the passageway comprises a surface at least partially defining a constricted section of the passageway;

a well configured to hold fuel delivered to the well from the fuel tank; and a nozzle in fluid communication with the well and directed into the passageway proximate to the constricted section of the passageway, whereby the constricted section of the passageway provides a relative low pressure in air passing through the passageway that draws fuel from the nozzle to the air;

a rotating tool driven by the engine; and a power boost system, wherein operation of the power boost system increases the combustion process in the engine and provides a power boost mode having a greater output for the engine.

10. The snow thrower of claim 9, wherein the power boost system is operated automatically.

11. The snow thrower of claim 10, wherein the power boost system further comprises a feedback system configured to automatically control the surface in response to a loading on the engine.

12. The snow thrower of claim 9, wherein the power boost system is operated manually.

13. The snow thrower of claim 12, wherein the surface is configured to be adjusted to change the area of the passageway through the constricted section; and wherein the power boost system is further configured to increase the area of the constricted section of the passageway.

14. The snow thrower of claim 12, further comprising a power boost button configured to activate the power boost system.

15. The snow thrower of claim 14, wherein the surface comprises a continuously variable geometry.

16. The snow thrower of claim 9, wherein the power boost system changes the constricted area of the passageway to at least one of a first configuration corresponding to greater air flow restriction of the constricted section and a second configuration corresponding to lesser air flow restriction of the constricted section.

17. A snow thrower comprising:

a frame;

wheels coupled to the frame;

a fuel tank;

an engine mounted to the frame, comprising:

an air intake;

a combustion chamber;

a passageway configured to channel air from the air intake to the combustion chamber, wherein the passageway comprises a surface at least partially defining a constricted section of the passageway, and wherein the surface is configured to be adjusted to change the area of the passageway through the constricted section;

a well configured to hold fuel delivered to the well from the tank; and a nozzle in fluid communication with the well and directed into the passageway proximate to the constricted section of the passageway, whereby the constricted section of the passageway provides a relative low pressure in air passing through the passageway that draws fuel from the nozzle to the air;

a rotating tool driven by the engine; and an automatic system, wherein the automatic system automatically adjusts the surface to change the area of the constricted section to increase the flow rate of air through the passageway to increase the combustion processes of the engine and provide a power boost mode having a greater output for the engine.

18. The snow thrower of claim 17, wherein the automatic system comprises a feedback system configured to automatically adjust the surface to change the area of the constricted section open to air passage based on a feedback responsive to loading on the engine.

19. The snow thrower of claim 17, further comprising an actuator coupled to the surface and configured to move the surface as a function of loading on the engine.

20. The snow thrower of claim 19, wherein the actuator is pressure-sensitive and configured to be responsive to changes in vacuum pressure of the engine.

* * * * *